United States Patent [19]

Okabe

[11] 4,129,075

[45] Dec. 12, 1978

[54] LINE PRINTER

[75] Inventor: Katsuhiko Okabe, Tokorozawa, Japan

[73] Assignee: Copal Company Limited, Tokyo, Japan

[21] Appl. No.: 849,113

[22] Filed: Nov. 4, 1977

Related U.S. Application Data

[63] Continuation of Ser. No. 698,204, Jun. 21, 1976, abandoned.

[30] Foreign Application Priority Data

Jun. 23, 1975 [JP] Japan ..... 50-77372

[51] Int. Cl.[2] ..... B41J 3/46; B41J 29/26

[52] U.S. Cl. ..... 101/99; 101/93.12; 400/22

[58] Field of Search ..... 101/93, 93.05, 93.11, 101/93.12, 93.20, 93.38–93.40, 93.48, 93.47, 95, 99, 110; 197/113; 235/61.9 R

[56] References Cited

U.S. PATENT DOCUMENTS

| | | | |
|---|---|---|---|
| 2,670,067 | 2/1954 | Canham | 197/113 |
| 2,800,213 | 7/1957 | Young | 197/113 |
| 3,019,880 | 2/1962 | Baccarelli | 197/113 |
| 3,805,696 | 4/1974 | Tsuji | 101/110 |
| 3,861,309 | 1/1975 | Mizutani et al. | 101/99 |
| 3,946,666 | 3/1976 | Yokoyama | 101/99 |

*Primary Examiner*—Edward M. Coven
*Attorney, Agent, or Firm*—Haseltine, Lake & Waters

[57] ABSTRACT

Line printer having a plurality of coaxially arranged rotatable printing rings each bearing a series of characters to selectively effect printing on a paper and a platen movable toward in contact with and away from the printing rings so as to effect printing on the paper interposed between the platen and the printing rings when the platen abuts against the printing rings, each of the printing rings being selectively arrested by a select lever actuated by the printing signal from a control system of the printer thereby positioning desired characters of the respective printing rings in the printing position at which the platen abuts against the printing rings so that a line of printing is produced on the paper simultaneously. The printer comprises a mechanism for additionally printing a mark such as an underline and the like adjacent to particular characters printed on the paper. The mechanism is moved to the printing position by a signal from the control system. The mechanism comprises a printing wire with portions supported by a pair of printing levers swingably arranged at opposite extremities of the coaxially arranged printing rings. The printing wire is supplied with ink from an ink supply each time it is moved out of the printing position.

2 Claims, 4 Drawing Figures

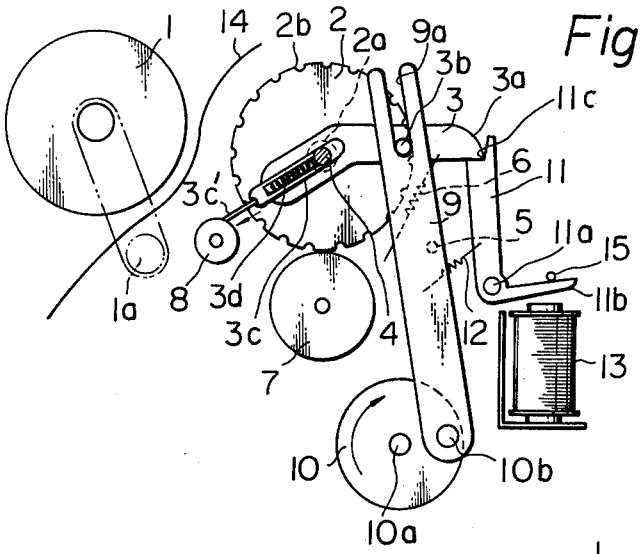
Fig. 1
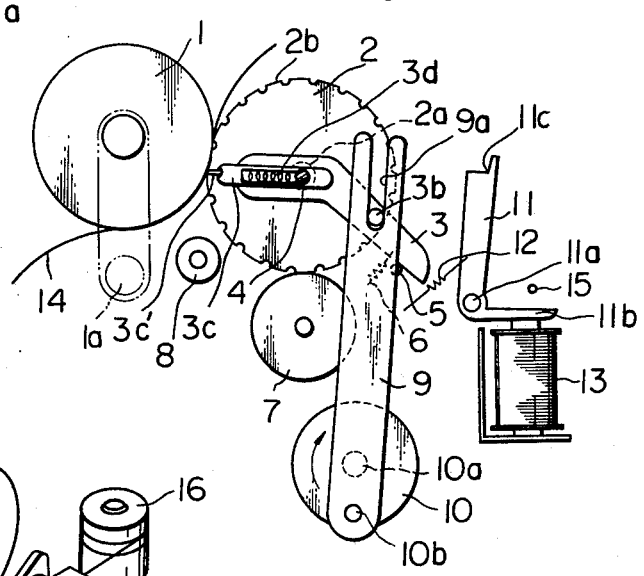
Fig. 2
Fig. 3
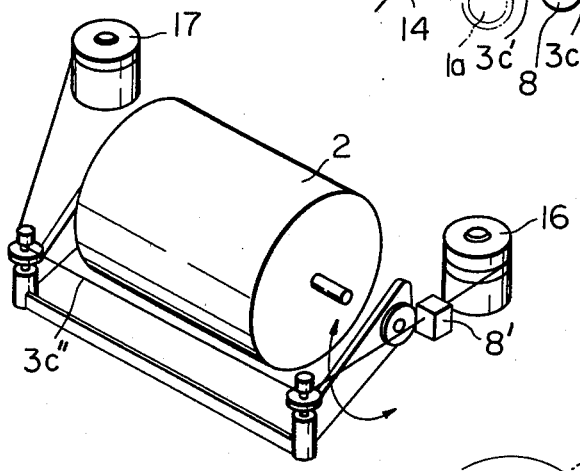
Fig. 4
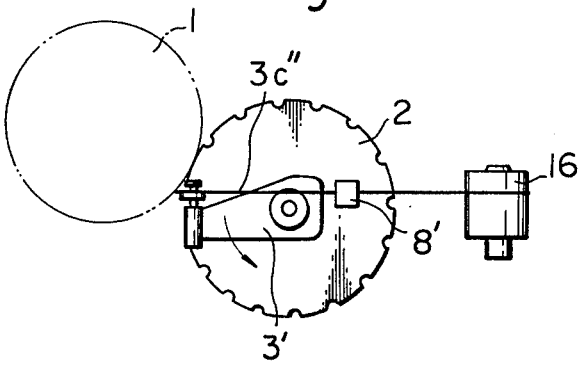

LINE PRINTER

This is a continuation of application Ser. No. 698,204 filed June 21, 1976 now abandoned.

FIELD OF THE INVENTION

The present invention relates to a line printer for effecting a line of printing simultaneously and having means for additionally and selectively printing a mark such as an underline adjacent the characters printed on a paper by the printer.

BACKGROUND

It has been desired to additionally print a mark such as an underline and the like adjacent to particular characters printed on the paper by the printer so that the end of a paragraph or the position of the particular characters is conveniently identified Heretofore, different color printing has been generally used to identify the particular characters so as to discriminate debits from credits in accounting, or the input from the output, or the process in accounting from the result. To this end, it is necessary to use two ink ribbons having different colors from each other or to provide two sets of printing rings when ink rollers having different colors are used for each of sets of printing rings.

When ink ribbons are used, the quality of printing tends to be poorer in comparison with printing using ink rollers, and the ribbons tend to be twisted or deflected during the operation thereby causing failure in printing or unevenness of printing. when the ink rollers are used, the construction of the printer is made very complicated thereby raising the manufacturing cost.

SUMMARY OF THE INVENTION

An object of the present invention is to provide a novel and useful line printer having means for additionally printing a mark such as an underline adjacent to particular characters printed on a paper by the printer so as to facilitate identification of the particular characters thereby eliminating the above described disadvantages of the prior art printer.

With the present invention, the particular characters to which the mark is additionally printed can be clearly discriminated from other characters as in the case in which different color printing is effected.

BRIEF DESCRIPTION OF THE DRAWINGS

FIG. 1 is a schematic side elevational view showing the main components of the line printer incorporating the present invention in one mode of operation;

FIG. 2 is a schematic side elevational view similar to FIG. 1 but showing another mode of operation;

FIG. 3 is a prespective view showing an alternative embodiment of the present invention; and FIG. 4 is a fragmentary side elevational view of FIG. 3.

DETAILED DESCRIPTION OF THE PREFERRED EMBODIMENTS

Prior to the description of the present invention, an example of the line printer in which the present invention is incorporated will be briefly described. Such a printer is disclosed in U.S. Ser. No. 643,617 filed by the same inventor as this application and assigned to the same assignee as this application, entitled "Line Printer".

In the line printer disclosed in the above described application, a plurality of printing rings are coaxially arranged in juxtaposed relationship on a driving shaft driven in two revolutions for each printing cycle by a motor upon issuance of a printing signal from a control system operated by an operator. Each of the printing rings bears on its periphery a series of characters to be printed on a paper by the printer and resiliently coupled with the driving shaft by a spiral spring so as to be rotated therewith and resiliently held at a starting position. Each of the printing rings has a ratchet wheel integrally secured thereto. Each of the ratchet wheels is releasably engageable with a select lever by a spring which select lever is actuated by the spring upon issuance of the printing signal to deenergize a magnet holding the select lever apart from the ratchet wheel during the first revolution of the driving shaft so that the printing ring is temporarily arrested by the engagement of the select lever with the rachet wheel while the driving shaft is rotating so as to temporarily locate the selected character of the printing ring to a printing position stationarily set at the periphery of the printing rings to be described later.

A platen is movably arranged so as to move toward the printing rings to come into contact therewith at the printing position and away from the printing rings and actuated through linkage means by a reduced speed shaft driven by the driving shaft at a speed one-half the speed of the driving shaft, i.e., driven for one revolution in each printing cycle, so that the platen abuts against the printing rings with a paper interposed therebetween at the end of one revolution of the driving shaft at which time the selected character on each printing ring has been located at the printing position to thereby effect printing of one line on the paper. During the second revolution of the driving shaft, the select levers are released from the ratchet wheels by energization of the magnets so that the printing rings are returned to the start positions relative to the driving shaft and the platen is moved apart from the printing rings by the linkage means and the paper is fed and the printing rings are supplied with ink on the periphery of each of the printing rings by an ink roller which is moved to rollingly contact the periphery of each printing ring by cam means driven by the reduced speed shaft thereby conditioning the printer for the next printing operation.

Since the construction of the line printer per se is not the subject matter of the present invention, no further detailed description thereof is given here.

Of course, any type of line printer other than that of the above described printer may incorporate the present invention.

Now, referring to FIGS. 1 and 2 showing an embodiment of the present invention, the platen 1 of the printer is swingably supported by a pair of levers rotatable about the shaft 1*a* so that the platen 1 is moved through the above described linkage means to abut the printing rings 2 having characters 2*b* on its peripheries, respectively, at the end of the first revolution of the driving shaft 2*a*, after the respective printing rings 2 have been selectively and temporarily arrested so as to locate the desired characters 2*b* in the printing position by the above described select levers for effecting printing of one line of printing on the paper sheet 14. After the printing of one line has been completed, the platen 1 is moved away from the printing rings 2 by the linkage means during the second revolution of the driving shaft 2*a* during which time the printing rings 2 are released from the select levers so as to assume their initial starting positions relative to the driving shaft 2*a* and the paper 14 is fed while the ink roller 7 is moved to abut the printing rings 2 to supply ink to the characters 2*b* of the printing rings 2 in the manner as described earlier.

In accordance with the present invention, a pair of printing levers 3 are swingably supported adjacent the opposite ends of the assembly of the printing rings 2, respectively, by shafts separately provided from the driving shaft 2*a* and preferably coaxial therewith. Each of the printing levers 3 has a pin 3*b* secured thereto and urged in the clockwise direction by a spring 6.

A frame member 3*c* is secured to each of the printing levers 3. A U-shaped printing wire 3*c*′ is provided and the bent legs of the 3*c*′ are received in the frame members 3*d*, respectively, while the base portion of the wire 3*c*′ extends parallel to the driving shaft 2*a* outside the peripheries of the printing rings 2. The bent legs of the wire 3*c*′ are urged outwardly by springs 3*d* provided in the frame members 3*c*, rspectively so that the base portion of the wire 3*c*′ is urged radially outwardly of the printing rings 2.

The clockwise rotation each of the printing levers 3 is limited by a stopper pin 5 provided in the printer frame.

In order to supply ink to the base portion of the printing wire 3*c*′, another ink roller 8 is provided parallel to the base portion of the wire 3*c*′, and, when the wire 3*c*′ is swung in the counterclockwise direction, the base portion of the wire 3*c*′ abuts against the ink roller 8 to supply ink to the wire 3*c*′ as shown in FIG. 1, while, when the wire 3*c*′ is swung in the clockwise direction in synchronism with the abutment of the platen 1 against the printing rings 2 or just before or after the abutment, the wire 3*c*′ is brought to the printing position as shown in FIG. 2 so that additional printing is effected by the wire 3*c*′ as described in detail hereinafter.

A pair of charging levers 9 are provided each having an elongated slot 9*a* at its upper end which slidably receives the pin 3*b* of the printing lever 3 while the lower end each of the charging levers 9 is pivotally supported by an eccentric pin 10*b* provided in a cam 10 rotatable about a shaft 10*a* so that, when the charging levers 9 are moved upwardly by the rotation of the cam 10, the printing levers 3 are moved in the counterclockwise direction by the pins 3*b* engaging the bottom of the slots 9*a* so as to abut the wire 3*c*′ against the ink roller 8, while, when the charging levers 9 are moved downwardly, the printing levers 3 are rotated in the clockwise direction by the action of the springs 6 so as to bring the printing wire 3*c*′ to the printing position.

In order to arrest the printing levers 3 so as to hold the printing wire 3*c*′ out of the printing position, a pair of L-shaped locking levers 11 are provided which are swingably supported by shafts 11*a* and have arresting shoulder portions 11*c* on upstanding arms of the levers 11 located adjacent the path of movement of the ends 3*a* of the printing levers 3, respectively, thereby permitting the shoulder portion 11*c* to releasably engage the ends 3*a* of the levers 3 to prevent clockwise rotation of the levers 3 to bring the wire 3*c*′ to the printing position while lower arms 11*b* are located adjacent electromagnets 13 energizable by the control system of the printer when an additional printing signal is issued therefrom so as to attract the levers 11 to release the shoulder portions 11*c* from the ends 3*a* of the levers 3 when energized.

The levers 11 are urged in the counterclockwise direction by springs 12 and the counterclockwise rotation of the levers 11 is limited by stopper pins 15 as shown.

The charging levers 9 are held at their lowermost positions by the rotation of the cam 10 after the printing levers 3 are arrested by the locking levers 11 after one cycle of printing operation as described later.

The operation of the above described embodiment of the present invention is as follows.

In the usual operation of the printer without requiring the additional printing of a mark, the printer is operated upon issuance of the printing signal from the control system as previously described with the electromagnets 13 deenergized so that the locking levers 11 arrest the printing levers 3 so as to maintain the printing wire 3*c*′ in engagement with the ink roller 8 as shown in FIG. 1.

When the additional printing is required, an additional printing signal is issued from the control system together with the usual printing signal by the manipulation of the operator so that the electromagnets 13 are energized to attract the arms 11*b* of the locking levers 11 thereby releasing the ends 3*a* of the printing levers 3 from the arresting shoulder portions 11*c* of the levers 11 to allow the printing levers 3 to rotate in the clockwise direction by the action of the springs 6. Thus, the printing wire 3*c*′ is moved in the clockwise direction when the platen 1 is moved to abut against the printing rings 2 for the printing of one line as shown in FIG. 2, so that additional printing by the wire 3*c*′ is effected together with the usual printing of one line of printing by the printing rings 2.

When the additional printing is completed, the cams 10 are rotated one half a revolution in the direction indicated by the arrow in FIG. 2 by the command from the control system so that the charging levers 9 are moved upwardly to rotate the printing levers 3 in the counterclockwise direction by the engagement of the pins 3*b* of the levers 3 with the bottom of the slots 9*a* of the levers 9 thereby permitting the ends 3*a* to slide along and over the upstanding arms of the levers 11 and to be arrested by the shoulder portions 11*c* of the levers 11, at which time the electromagnets 13 have been held deenergized. Therefore, the levers 3 and the printing wire 3*c*′ are held as shown in FIG. 1.

After the levers 3 are arrested, the cams 10 are rotated a further half revolution so as to locate the charging levers 9 at their lowermost positions shown in FIG. 2. One revolution of the cams 10 so as to arrest the levers 3 and move the levers 9 to their lowermost positions may be effected by conventional one revolution clutches and the actuation of such one revolution clutches may be effected during any phase in the cycle of the printing operation after the completion of printing of one line and before the commencement of the next cycle of the printing operation.

The additional printing signal may be incorporated in the usual printing signal.

The movement of the printing wire 3*c*′ to the printing position may be effected just before or after the abutment of the platen 1 against the printing rings 2 as well as in synchronism with the abutment of the platen 1 against the printing rings 2.

In the above description, two sets of cams 10 and two sets of electromagnets 13 are provided. However, they may be only one set, respectively, insofar as the two charging levers 11 are actuated by the the single cam 10 and the pair of levers 11 are interconnected so as to be actuated simultaneously by a single electromagnet 13.

FIGS. 3 and 4 show an alternative embodiment of the present invention. This embodiment is generally similar in construction to that shown in FIGS. 1 and 2 except that the printing wire 3c″ is successively fed from a supply reel 16 through an ink supply means 8′ and on rollers provided at the tips of the printing levers and wound on a winding reel 17. The operation is similar to that shown in FIGS. 1 and 2.

I claim:

1. In a line printer having a printing mechanism comprising a plurality of coaxially arranged rotatable printing rings each bearing on the periphery thereof a series of characters to selectively effect printing on a paper, a platen movable toward the printing rings to abut thereagainst with the paper interposed therebetween and away therefrom so as to free the paper and permit the paper to be advanced, means for selectively and temporarily arresting each printing ring so as to locate a selected character in a printing position at which the platen abuts against the respective printing rings for simultaneously printing a line of printing on the paper by the selected characters, the improvement comprising additional printing means for selectively and additionally printing a mark adjacent particular characters printed on the paper, the additional printing means being movable from a retracted position to a printing position for effecting the additional printing, and means supporting said additional printing means for pivotal movement along the outer periphery of the printing rings, said additional printing means comprising a printing wire having portions supported by a pair of printing levers each swingably supported adjacent opposite extremities of the coaxially arranged printing rings, spring means for biasing the pair of printing levers so as to urge the printing wire to the printing position, arresting levers means releasably engageable with the pair of printing levers, respectively, so as to arrest the printing wire in the retracted position against the action of the spring means, solenoid means cooperating with the arresting lever means for releasing the arresting lever means from the printing levers, and charging lever means for urging the printing levers, so as to permit the arresting lever means to arrest the printing levers in the retracted position of the printing wire, and rotatable cam means operably coupled with the charging lever means for discharging the charging lever means to to urge the printing levers to retract position so as to be arrested by the arresting lever means.

2. Printer according to claim 1, further comprising means for supplying printing ink to the additional printing means when the additional printing means is moved away from the printing position.

* * * * *